US009988784B2

(12) United States Patent
Barron et al.

(10) Patent No.: US 9,988,784 B2
(45) Date of Patent: Jun. 5, 2018

(54) RAPID PIER

(71) Applicant: Uretek USA, Inc., Tomball, TX (US)

(72) Inventors: Brent Barron, Tomball, TX (US); Randall W. Brown, Pensacola, FL (US); Edward Hibbard, Conroe, TX (US)

(73) Assignee: URETEK USA, INC., Tomball, TX (US)

( * ) Notice: Subject to any disclaimer, the term of this patent is extended or adjusted under 35 U.S.C. 154(b) by 0 days. days.

(21) Appl. No.: 14/799,393

(22) Filed: Jul. 14, 2015

(65) Prior Publication Data

US 2016/0017562 A1 Jan. 21, 2016

Related U.S. Application Data

(60) Provisional application No. 62/024,759, filed on Jul. 15, 2014.

(51) Int. Cl.
*E02D 5/34* (2006.01)

(52) U.S. Cl.
CPC ..... *E02D 5/34* (2013.01)

(58) Field of Classification Search
CPC .... E02D 5/00; E02D 5/34; E02D 5/36; E02D 5/38; E02D 5/46
USPC ..... 405/233, 240, 244, 249
See application file for complete search history.

(56) References Cited

U.S. PATENT DOCUMENTS 3,206,935 A 9/1965 Phares
3,638,433 A * 2/1972 Sherard ..... E02D 1/04 405/50
3,690,106 A * 9/1972 Tregembo ..... E02D 3/12 166/299
3,735,541 A * 5/1973 Vanderlinde ..... E02D 5/808 405/244
3,925,998 A * 12/1975 LeCorgne ..... E02D 5/226 405/242
4,018,056 A * 4/1977 Poma ..... E02D 5/36 405/233
4,152,089 A * 5/1979 Stannard ..... E02D 5/385 405/232
4,487,528 A * 12/1984 Skogberg ..... E21D 21/0073 405/244
4,571,126 A * 2/1986 Granstrom ..... E02D 5/805 405/237
4,618,289 A * 10/1986 Federer ..... E02D 5/385 405/233

(Continued)

FOREIGN PATENT DOCUMENTS

JP H40718651 A 1/1995
WO WO 2012085342 A1 * 6/2012 ..... E02D 27/34
WO 2012152999 A1 11/2012

*Primary Examiner* — Benjamin F Fiorello

(74) *Attorney, Agent, or Firm* — Norton Rose Fulbright US LLP

(57) ABSTRACT

A method and apparatus for rapidly constructing a structural pier comprising the steps of placing into a soil under a structure to be supported a casing having an inner diameter and an outer diameter, positioning an injection tube into the inner diameter of the casing, and injecting an expansive material into the casing. Optional perforations in the casing allow some of the expansive material to be ejected from the casing into the surrounding soil to create fingers or branches for the purpose of adding friction to the structural pier.

6 Claims, 12 Drawing Sheets

(56) References Cited

U.S. PATENT DOCUMENTS 4,708,529 A 11/1987 Lindell
5,123,209 A * 6/1992 Nally ..... E02D 35/00 175/314
6,533,036 B1 * 3/2003 Baret ..... E21B 33/138 166/290
6,634,831 B2 * 10/2003 Canteri ..... E02D 3/12 405/263
6,821,056 B1 11/2004 Mansour
6,869,255 B1 * 3/2005 Beck, III ..... E02D 33/00 405/233
7,097,388 B1 * 8/2006 Mansour ..... E02D 35/00 405/230
7,226,246 B2 6/2007 Fox
7,338,233 B2 * 3/2008 Barrett ..... E02D 3/12 173/90
7,517,177 B2 * 4/2009 Erdemgil ..... E02D 27/34 405/229
8,246,276 B2 * 8/2012 Bower ..... E21D 15/483 299/11
8,596,922 B2 * 12/2013 McVay ..... E02D 5/44 405/232
2004/0104049 A1 * 6/2004 Federighi ..... E02D 5/36 175/57
2004/0247397 A1 * 12/2004 Fox ..... E02D 5/46 405/248
2008/0019779 A1 * 1/2008 Henderson ..... E02D 5/38 405/237
2009/0155002 A1 6/2009 Hakkinen et al.
2009/0269146 A1 * 10/2009 Miljovski ..... E02D 5/54 405/233
2010/0272518 A1 10/2010 Barron et al.
2011/0052330 A1 * 3/2011 Wissmann ..... E02D 3/08 405/233
2012/0328375 A1 * 12/2012 Perkins ..... E02D 5/808 405/233
2013/0051929 A1 * 2/2013 Hakkinen ..... E02D 5/46 405/263
2013/0129423 A1 5/2013 Hakkinen et al.
2013/0243533 A1 9/2013 Tarapchak
2013/0309023 A1 * 11/2013 Takagi ..... B21C 37/158 405/231
2014/0017015 A1 1/2014 Hakkinen et al.
2014/0112722 A1 4/2014 Chin

* cited by examiner

RAPID PIER

CROSS-REFERENCE TO RELATED APPLICATIONS

This Application claims the benefit of U.S. Provisional Application 62/024,759 filed on Jul. 15, 2014, which is hereby incorporated by reference in its entirety.

TECHNICAL FIELD

This disclosure relates generally, but not by way of limitation, to structural bored piers or pilings for the purpose of supporting overlying structures such as buildings, highways, bridges, or the like.

BACKGROUND OF THE INVENTION

In scenarios where poor soil exists at shallow depths, or where large loads are contemplated, deep foundations may be advantageous. These foundations are effective at handling larger loads and provide lateral resistance. Bored piers and piles refer to types of foundations that are constructed by drilling into the earth and subsequently placing materials with stronger compressive strength in the excavation to form a foundation unit. These foundations are often referred to collectively as drilled-shaft foundations. The materials used traditionally to form these pier systems are concrete, steel, and cement grout. For example, in a typical drilled shaft foundation, an auger is used to drill a hole of planned diameter to the design depth. Then a full-length reinforcing steel frame is lowered into the hole and the hole is subsequently filled with concrete. The reinforced caisson, as it is sometimes called, can be used to support heavy loads like buildings, bridges, towers, etc. It resists compressive and lateral loads, as well as uplift tendencies.

Unfortunately, existing construction methods suffer certain drawbacks. For example, the materials currently used, such as concrete and steel, themselves add significant weight to an already weak soil system. In addition, construction of individual piers is time consuming and difficult in the face of certain ground conditions such as excessive free water. Likewise, cure time for concrete and cement grout delays the time until the foundation can be loaded. Delays such as these are significant drawbacks where the above structure is in use, such as with a highway. A need exists for a rapid pier system and method that can be put in place in less time with less weight, but still offer high strength and bearing capacity.

BRIEF SUMMARY OF THE INVENTION

The present invention is directed to a method for constructing a structural pier comprising the steps of placing into a soil under a structure to be supported a casing having an inner diameter and an outer diameter, lowering an injection tube into the inner diameter of the casing, injecting an expansive material into the casing. In one embodiment, the overlying structure is already in place. In another, the structure is yet to be built. In one embodiment, the expansive material is a polymer expansion foam. In another embodiment, it is a two-component polymer that chemically reacts. The polymer, in one embodiment, has a fast rise time so that it reaches 90% compressive strength in one hour. In another embodiment, the polymer reaches 90% compressive strength in 30 minutes. In one embodiment, the casing comprises perforations for allowing some of the expansive material to be ejected from the casing into the surrounding soil to create fingers or branches for the purpose of at least adding friction.

In one embodiment of the method, the injection tube is vertically raised or lowered inside the inner diameter of the casing to a region not containing expanded material and then the expansive material is injected into the casing. One embodiment of the method includes capping the casing to either keep the expansive material in a certain region of the casing, or to keep the expansive material from ejecting vertically to the surface. In one embodiment, the casing contains circular perforations. In another, the perforations are slotted. In one embodiment, the method comprises drilling a hole under the structure to be supported and injecting an expansive material into a region located between the exterior of the casing and the interior of the hole. In one embodiment, the casing is scored. In another embodiment, the perforations of the casing are engineered to direct the ejected expansive material into the surrounding soil. For example, perforations can be angled to direct the expansive material left, right, up, or down of the perpendicular axis of the casing wall.

In one embodiment, multiple rapid piers are placed in a geometric configuration. Tie-in injections can then be initiated, interspersed between the rapid piers so that the fingers or branches are tied together to create a stronger pier structure. In one embodiment, an expandable container is placed beneath the rapid pier casing. This expandable container can be injected with expansive material to create a bell or base beneath the pier.

The foregoing has outlined rather broadly the features and technical advantages of the present disclosure in order that the detailed description that follows may be better understood. Additional features and advantages will be described hereinafter which form the subject of the claims herein. It should be appreciated by those skilled in the art that the conception and specific embodiments disclosed may be readily utilized as a basis for modifying or designing other structures for carrying out the same purposes of the present designs. It should also be realized by those skilled in the art that such equivalent constructions do not depart from the spirit and scope as set forth in the appended claims. The novel features which are believed to be characteristic of the designs disclosed herein, both as to the organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
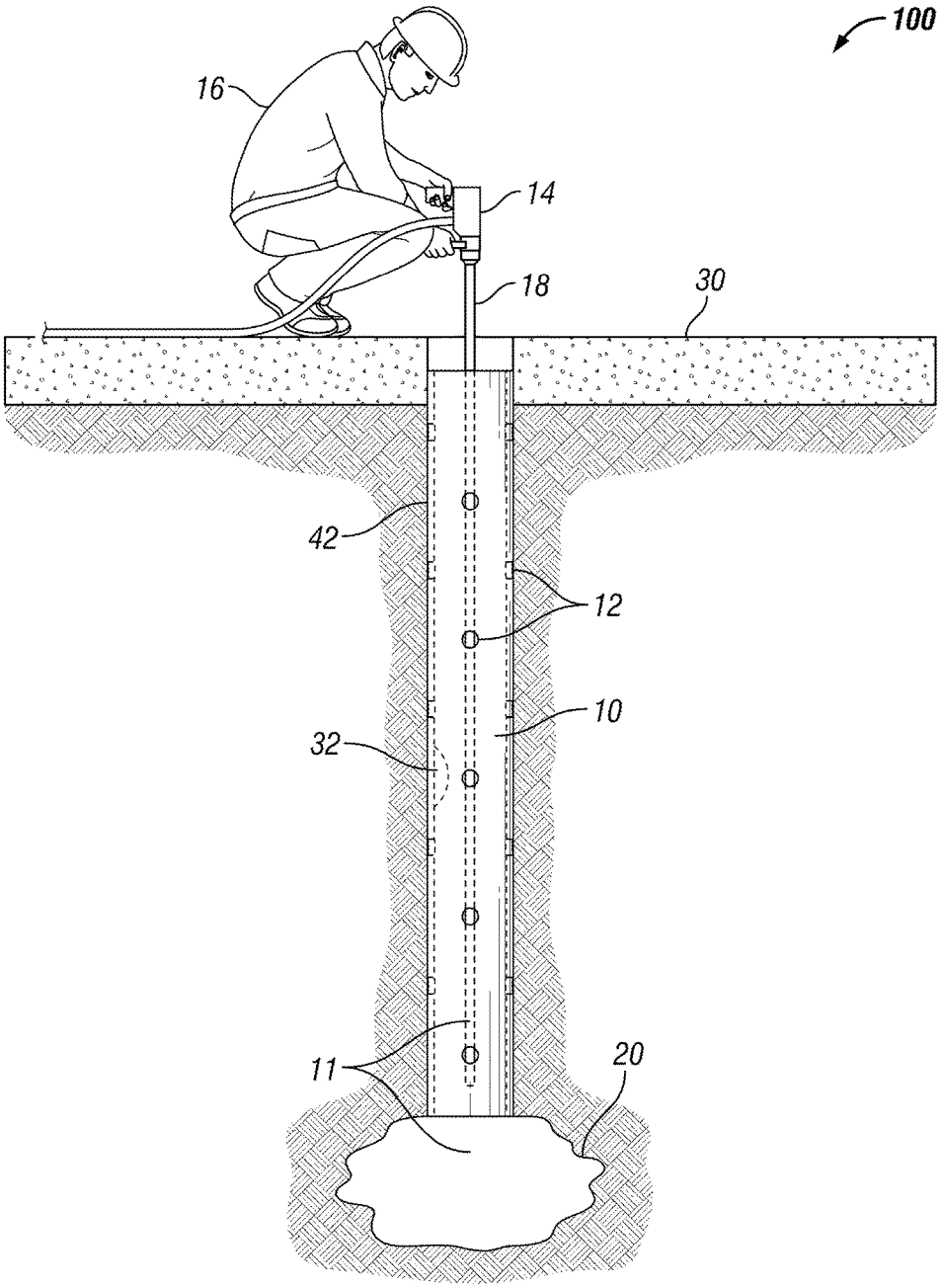
FIG. 1 depicts an embodiment of the rapid pier according to the present disclosure.

Current drilled-shaft foundations incur several drawbacks, not the least of which is the addition of excess weight to the overall structure being supported. Along the same vein, prior art concrete and cement grout piers add delay to a construction or repair job because loads cannot be applied while the concrete/cement cures. Furthermore, excess water in the soil complicates installation and setting of prior art piers.

The rapid pier design disclosed herein addresses these issues. According to one embodiment of the present disclosure, there is presented a method for providing improved structural support for overlying structures. In one embodiment, the method comprises drilling a hole to a desired diameter and length and subsequently inserting a lightweight casing or pipe 10. The casing 10 can be fashioned of various materials such as, fiberglass, synthetic plastic polymers like polyvinyl chloride (PVC), or paper and adhesives like that of the brand Sonotube. Other lightweight plastics, papers, or alternatives may be used.

In one embodiment, expansive material 11 is injected near the base of the casing 10, so that the expansive material 11 expands out into the soil under and around the base of the casing to form a base or a bell 20, which increases the bearing capacity of the pier and decreases any vertical movement of the pier. According to one embodiment, injections are then made at consecutive regions within the casing, working upwards or downwards region by region. Expansive material 11 fills the casing and the casing provides confinement of the expansive material 11 so that the material increases in compressive strength. Injection locations then shift upward or downward, where expansive material 11 continues to enter regions of the casing and expand in confinement. This continues until the top or bottom of the casing is reached.

The expansion under confinement of the expansive material 11 results in a strong and rigid pier. In some embodiments, expansive material 11 with quick reaction times is used, so that the pier can be quickly ready to bear loads. In one embodiment, a two-component, high-density polymer is used as the expansive material, such as the Uretek 486 STAR line of polymers. Because the polymer is injected into the casing one region at a time, the polymer is allowed to cool after each chemical reaction, which allows the pier to quickly reach a preferred state so it can bear the load of the structure above it, whether that state is cream, gel, tack-free, or end-of-rise. In one embodiment, the polymer reaches 90% of its compressive strength within one hour of injection and 100% of its compressive strength within 24 hours of injection. This allows the pier to be put in use very quickly. In another embodiment, the polymer is formulated to reach 90% of its compressive strength within 30 minutes. In yet another embodiment, the polymer reaches 90% in 15 minutes. In one embodiment, the polymer is formulated to prevent water intrusion into the chemical reaction that forms the structural polymer, thereby ensuring the integrity of the polymer. In one embodiment, the expansive material comprises a two-part polymer that expands to at least three times its initial liquid volume in a free-rise condition. In another embodiment, the expansive material comprises a one-part polymer that expands to at least three times its initial volume in a free-rise condition. According to this embodiment, activator for the one-part polymer is contained within the soil, either naturally, or as provided prior to, or after, injection of the one-part polymer. In one embodiment, the activator is water.

Figure 2:
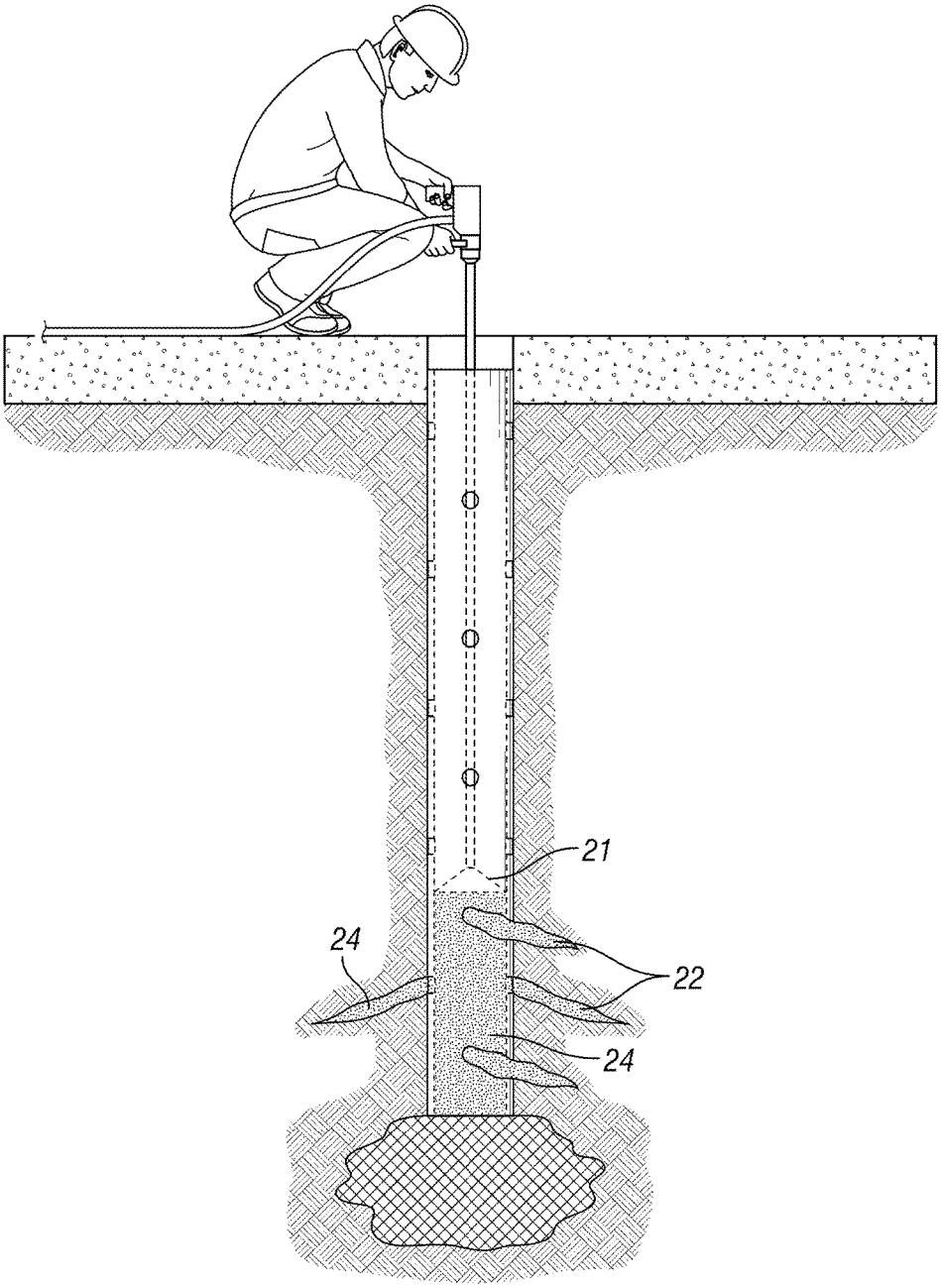
FIG. 2 shows a various stage of one embodiment of the rapid pier.

An embodiment of the present disclosure is shown in FIG. 1. There is presented the method of setting in soil under a structure a casing or pipe 10 of certain length, diameter, and construction material. According to one embodiment, a hole is pre-drilled or augered to accept pipe 10. In another embodiment, pipe 10 is driven into the ground in situ. A tube 18 is lowered into the interior diameter of pipe 10 to the bottom portion of pipe 10. Expansive material is then injected into tube 18, for example by operator 16 using injection tool 14. The expansive material exits at the bottom of pipe 10 to form a base or bell 20 under the rapid pier. After enough expansive material is injected to form base 20, operator 16 raises tube 18 to a location situated in a lower segment 24 of pipe 10. See FIG. 2. Operator 16 then injects expansive material into tube 18 where it exits tube 18 into the interior diameter of lower region 24.

In one embodiment, injection tube 18 includes a circular cap 21 of similar diameter to the inner diameter of pipe 10. The cap can be placed at a location on injection tube 18 so that it correlates to the top or bottom of the injection region (such as region 24, 26, or 28). The cap, as contemplated herein, reduces expansion of the expansive material in the vertical direction, thereby ensuring the expansive material reaches full compressive strength within the pier. By injecting expansive material 11 in confined or restricted space, compressive strength of material 11 is improved. The cap can be made of any material suitable to reduce the expansion flow of the expansive material 11. One of ordinary skill in the art would understand how to affix cap 21 to the apparatus. In one embodiment, cap 21 is affixed to tube 18. In another embodiment, cap 21 is affixed to casing or pipe 10 and tube 18 is stabbed through cap 21 prior to injection. In one embodiment, cap 21 is fashioned from sponge or sponge-like material. Though the preferred shape of cap 21 is circular to match pipe 10, one of ordinary skill in the art would recognize that cap 21 can be of any shape that successfully reduces flow of expansive material through pipe 10. For example, cap 21 may be made from a square malleable material that conforms to the shape of pipe 10 when inserted. In one embodiment, also contemplated herein, a layer of expansive material is first injected near the top of a given region (24, 26, 28) to fashion a barrier between regions. Once two regions are separated by this initial injection of expansive material, the region below said barrier is injected with expansive material until the required compressive strength is reached, or the requisite amount of expansive material is injected. In this way, cap 21 is not required.

Figure 6:
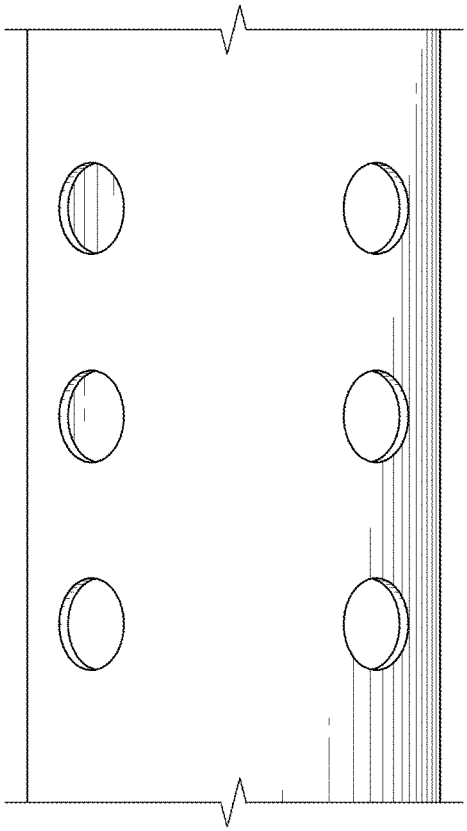
FIG. 6 depicts one embodiment of a casing with perforations.
Figure 7:
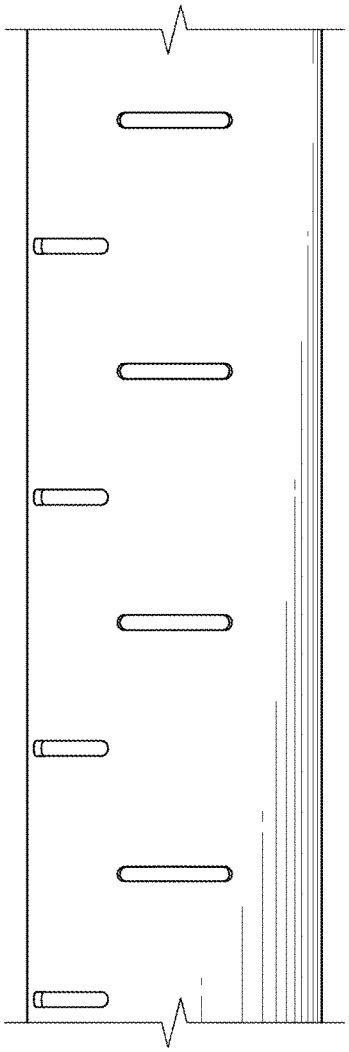
FIG. 7 shows a casing with slots, according to one embodiment.

According to one embodiment, pipe 10 contains perforations 12. Perforations can take many shapes and sizes. As expansive material is injected into lower region 24 of pipe 10, small amounts of expansive material escape pipe 10 through perforations 12 to cause fingers or branches 22. In some cases, the fingers/branches 22 link up within the soil to form wing-like shapes. These fingers 22 serve as anchor points to increase friction between the pier and surrounding soils. The design of the perforations may correlate to the consistency of the soil. For example, unusually soft soils may warrant smaller holes to prevent too much expansive material ejecting from the pipe into the surrounding soil. Likewise, perforations can be slotted, as seen in FIG. 7 or rounded as in FIG. 6. Slots can be oriented to best anchor pipe 10. For example, slots can have a horizontal orientation to better reduce vertical movement when under load. Or slots can be vertically oriented to allow the expansive material to link up with material from other perforations. Other orientations and configurations are possible.

Pipes can be of different diameters, depending on the load bearing preferences, the soil, cost, and other engineering design parameters. For example, pipe 10 may have a diameter on the order of inches, such as 3 inches or 5 inches. Larger diameter pipes 10 are also contemplated, for example with diameters reaching multiple feet, such as 2 or 3 feet. Likewise, pipe 10 need not be uniform in diameter, but can be individually tailored to the engineering need. For example, a pipe 10 can have a larger diameter lower portion tapering into a smaller diameter upper region, or vice versa. Pipes can be sunk at varying depths. Many built structures, for example, may only require piers having a depth of 10 feet or less. Larger structures, or structures built above loose topsoil, however, may require deeper piers. According to the present disclosure, there is presented the option of sinking pipe 10 dozens of feet below the surface, for example at 50 feet or 70 feet or deeper. For deep piers, one embodiment allows for mixing of two-part polymer expansive material below the surface, closer to the target injection area.

Figure 3:
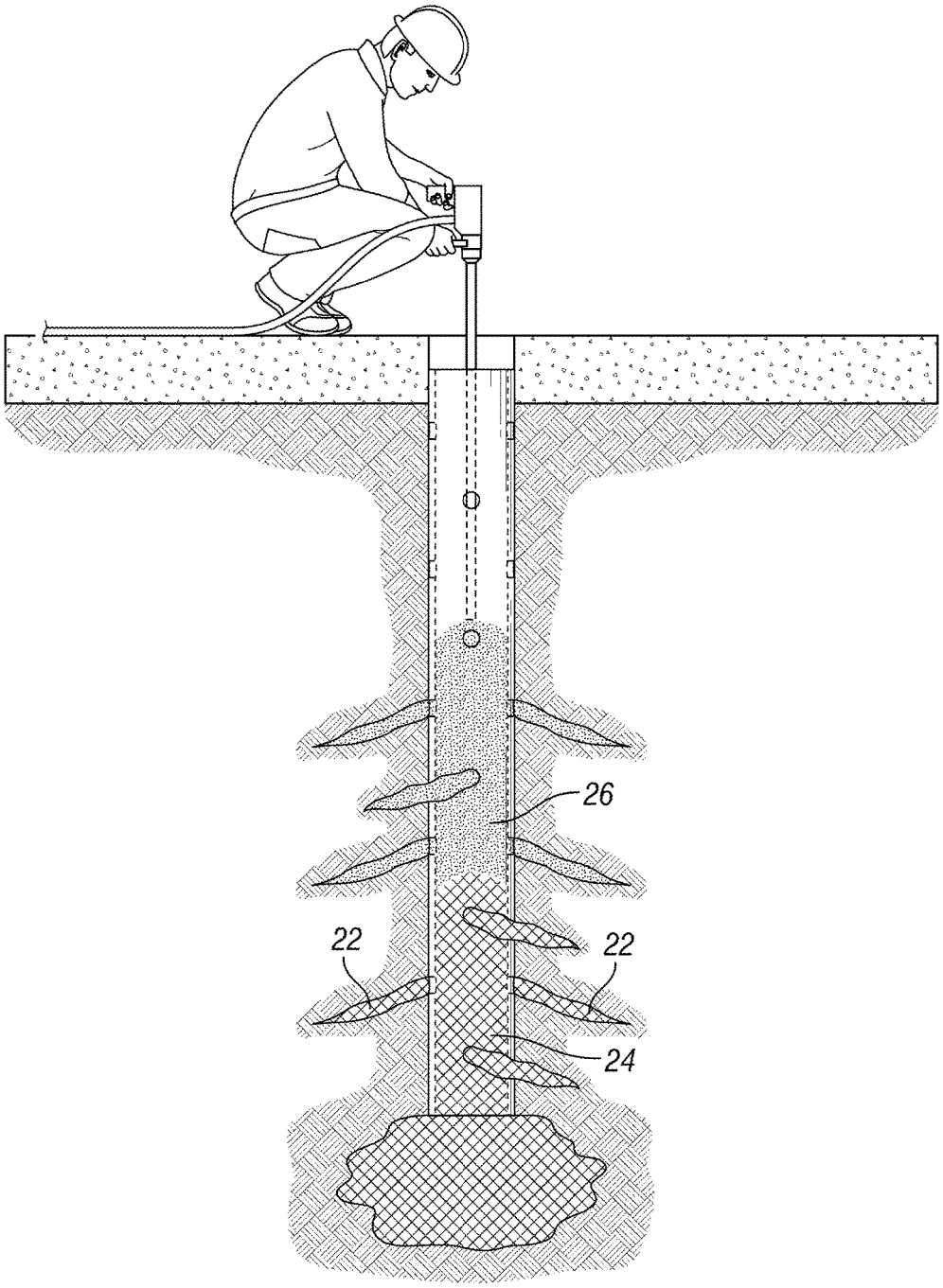
FIG. 3 shows an additional stage of one embodiment of the rapid pier.

Returning now to FIG. 3, operator 16 continues to prepare the pier by drawing injection tube 18 upwards to region 26. Using impingement gun 14, operator 16 then injects region 26 with expansive material according to the same method described above in reference to region 24. Operator 16 may choose to delay injection of region 26 to allow expansive material 11 in region 24 to cool.

Figure 4:
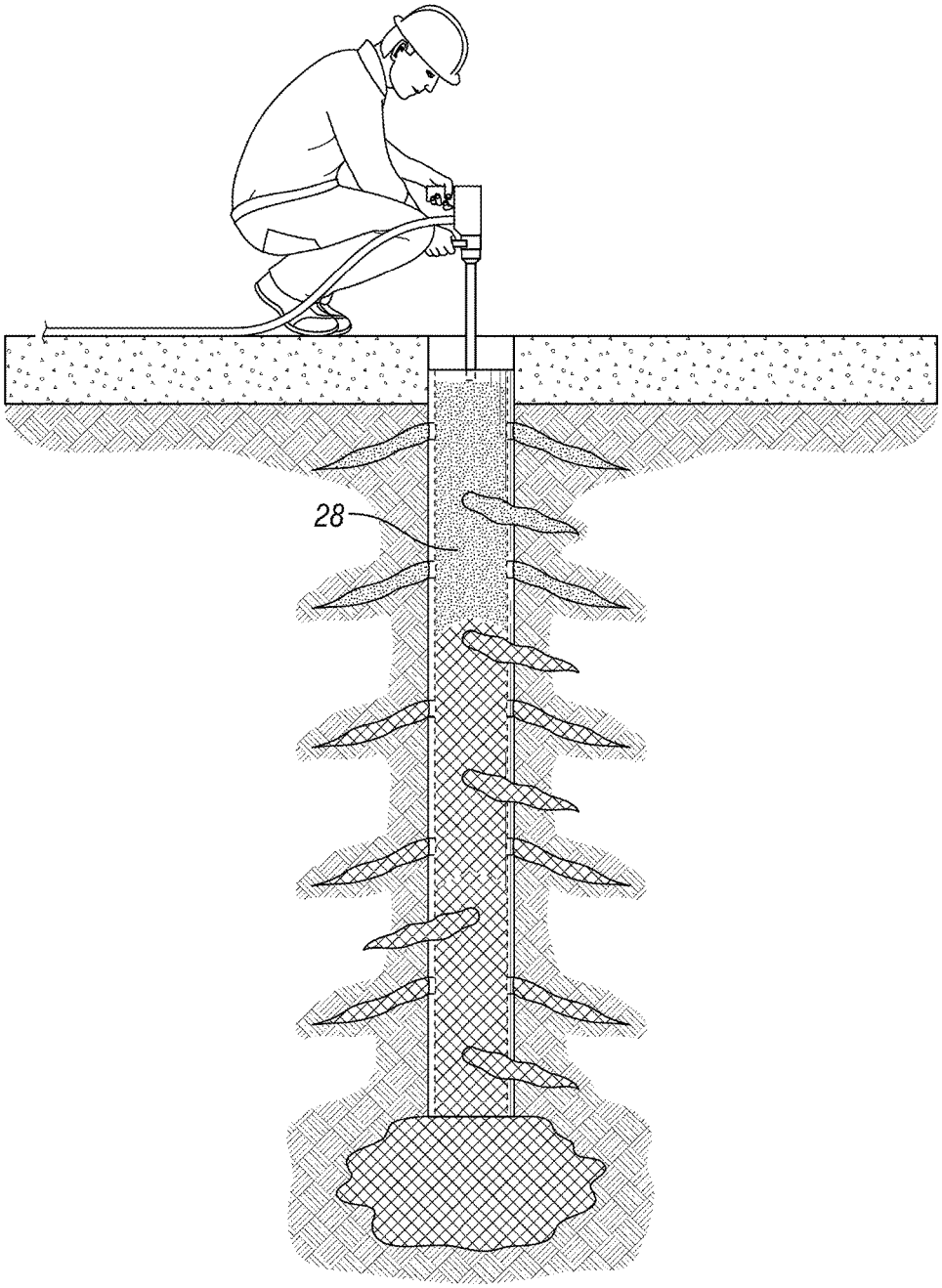
FIG. 4 shows an additional stage of one embodiment of the rapid pier.

In FIG. 4, operator 16 injects into the top region 28 of pipe 10. The top of pipe 10 can be capped (not shown) to prevent expansive material 11 from ejecting to the surface through the exposed inner diameter opening at the top of pipe 10. According to one embodiment, perforations 12 in region 28 are specifically shaped to eject expansive material under structure 30 to further add structural load bearing capacity. In another embodiment, casing 10 is sunk under the lower level of structure 30 so that structural patches to structure 30 rest on the finished pier, thus providing bearing capacity.

Figure 9:
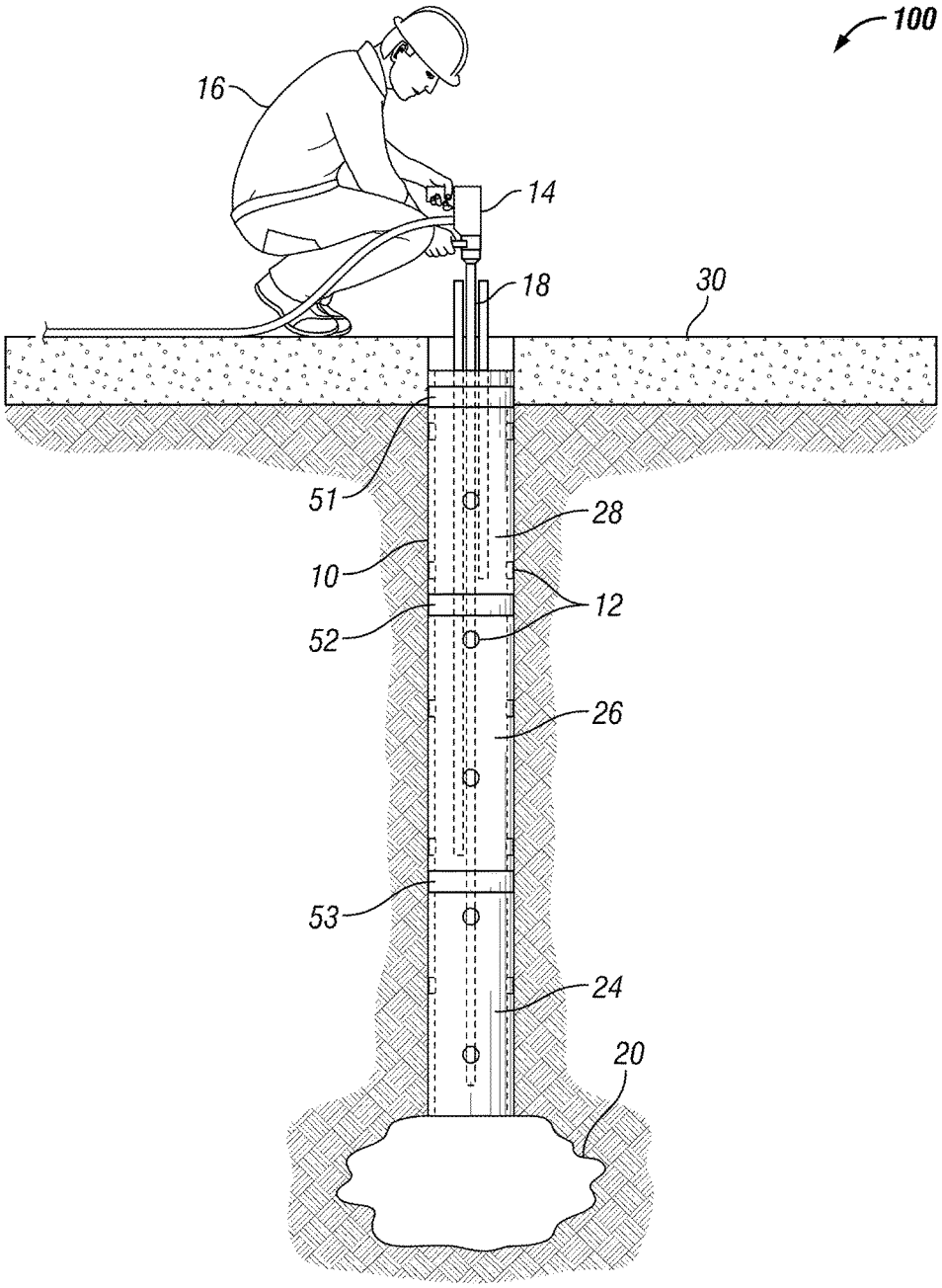
FIG. 9 represents an alternative embodiment of the rapid pier.

In another embodiment, operator 16 injects from the top down, as shown in FIG. 9. The top down approach has the added benefit of building a reaction mass above the injection to provide resistance to the expansive material 11. In this embodiment, multiple tubes 18 may be used. For example, three tubes 18 may be lashed together and inserted through three corresponding caps 21. Each tube 18 has a different vertical terminating height. In this embodiment, operator 16 first injects expanding material in upper region 28, located between caps 51 and 52. Because operator 16 knows the volume of upper region 28, operator 16 can estimate the amount of expansive material 11 required for that region. After injecting in upper region 28, operator 16 may then wait for the expanding material to cool, or operator 16 can begin injecting into middle region 26 through the second tube 18. Likewise, operator 16 finishes by injecting into lower region 26 near the bottom of pipe 10. As mentioned, this embodiment provides a stiff horizon, or reaction mass. The reaction mass confines the injected polymer, making it denser and stronger.

In one method, the operator injects a prescribed amount of expansive material 11 into casing 10 based on the conditions and project objective in order to attain the preferred compressive strength and load bearing conditions. For example, a designer or engineer may calculate the injection amount considering the soil conditions, namely the volume of any void, the soil type, soil stiffness, moisture content, and other conditions. The amount of expansive material to be injected may also depend on the magnitude of loading to be resisted and/or the magnitude and uniformity of settlement to be resisted. This information is transferred to the operator who accordingly injects the requisite amount of expansive material into each region of casing 10. In another embodiment, there is provided a pressure monitoring apparatus 32, such as a hydraulic pressure bulb. The pressure monitoring apparatus can be one of any type of pressure monitoring devices known in the art. The pressure monitoring apparatus 32, in one embodiment, is affixed to the inner surface of casing 10, as represented in FIG. 1. As expansive material 11 is injected into casing 10, internal pressure is monitored at the surface by way of a gauge that reads information from pressure monitoring apparatus 11. Operator 16 can terminate the injection at a certain pressure level, taking into account the rise time of the expansive material. In another embodiment, the pressure monitoring apparatus is lowered into casing 10, for example, attached to injection tube 18. Pressure monitoring apparatus 32, in one embodiment, can be affixed to the outside of casing 10, where there is enough space between casing 10 and a borehole. See discussion related to FIG. 8 below.

Figure 5:
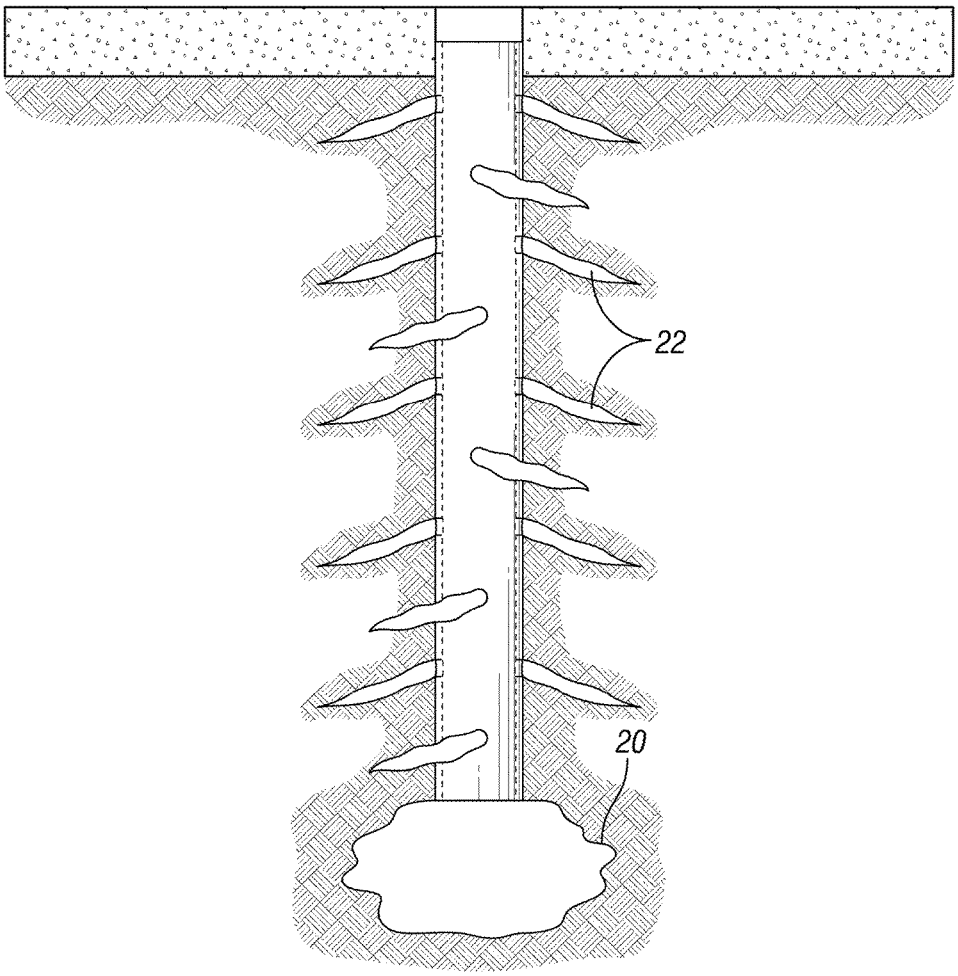
FIG. 5 shows one embodiment of a rapid pier with perforations according to the present disclosure.

FIG. 5 represents a completed pier. Fingers or branches 22 of expansive material are shown extruding from the casing and a bell or base 20 is shown at the bottom of the casing. Depending on the expansive material 11 used, and on the soil injected into, fingers or branches 22 may link up to create fin-like shapes.

In one embodiment, rapid piers have side injection ports. This embodiment is useful where the upper end of pipe 10 is blocked, such as where a structure 30 is already in place above pipe 10. Flexible hoses can attach to the side injection port of the rapid pier in order to provide access to the interior region of pipe 10. In one embodiment, tubes 18 (or expansive injection pathways) are already in place when pipe 10 is sunk in the foundation soil. Flexible hoses attached to side ports provide fluid communication with these pathways so that operator 16 can inject expansive material 11 at any time during a construction build. As contemplated herein, injection tubes 18 can be prefabricated within a casing 10, prior to insertion in the soil, such that injection tubes 18 have injection ports available to operator 16. Each tube, or pathway, may terminate in a selected region 24, 26, 28.

Likewise, rapid piers may be placed under a built structure 30 by method of tunneling, so as to leave the above structure 30 untouched. In one embodiment, pipes 10 telescope. By way of directional drilling, boreholes 42 can be prepared under a built structure from a point of origin away from the side of the structure. The operator can then tunnel to the borehole 42 and sink pipe 10, which telescopes its way to the bottom of borehole 42. In another embodiment, pipe 10 is sunk piecemeal, connecting each segment by way of threaded connection known in the casing industry. In another embodiment, segments of pipe 10 are not connected, but rather rest on each other under weight from above, such as where a stiff horizon is created. In another embodiment, pipe 10 is flexible, and can be unfurled or unfolded by air compression, or by way of expansive material 11 injection itself. In yet another embodiment, horizontal pipes 10 are embedded in the foundation soil, providing a lattice structure under a foundation.

The upper edge of a rapid pier can be embedded in the soil below the foundation of a built structure, within the foundation of a built structure, level with the surface of the foundation, or above it. One of ordinary skill in the art would understand the preferred placement of the top edge of pipe 10 according to the design parameters of the task at hand. Contrast, for example, FIG. 1, showing the termination of the upper edge of pipe 10 within the foundation 30, with FIG. 8, showing the upper edge terminating just below the foundation 30.

Figure 8:
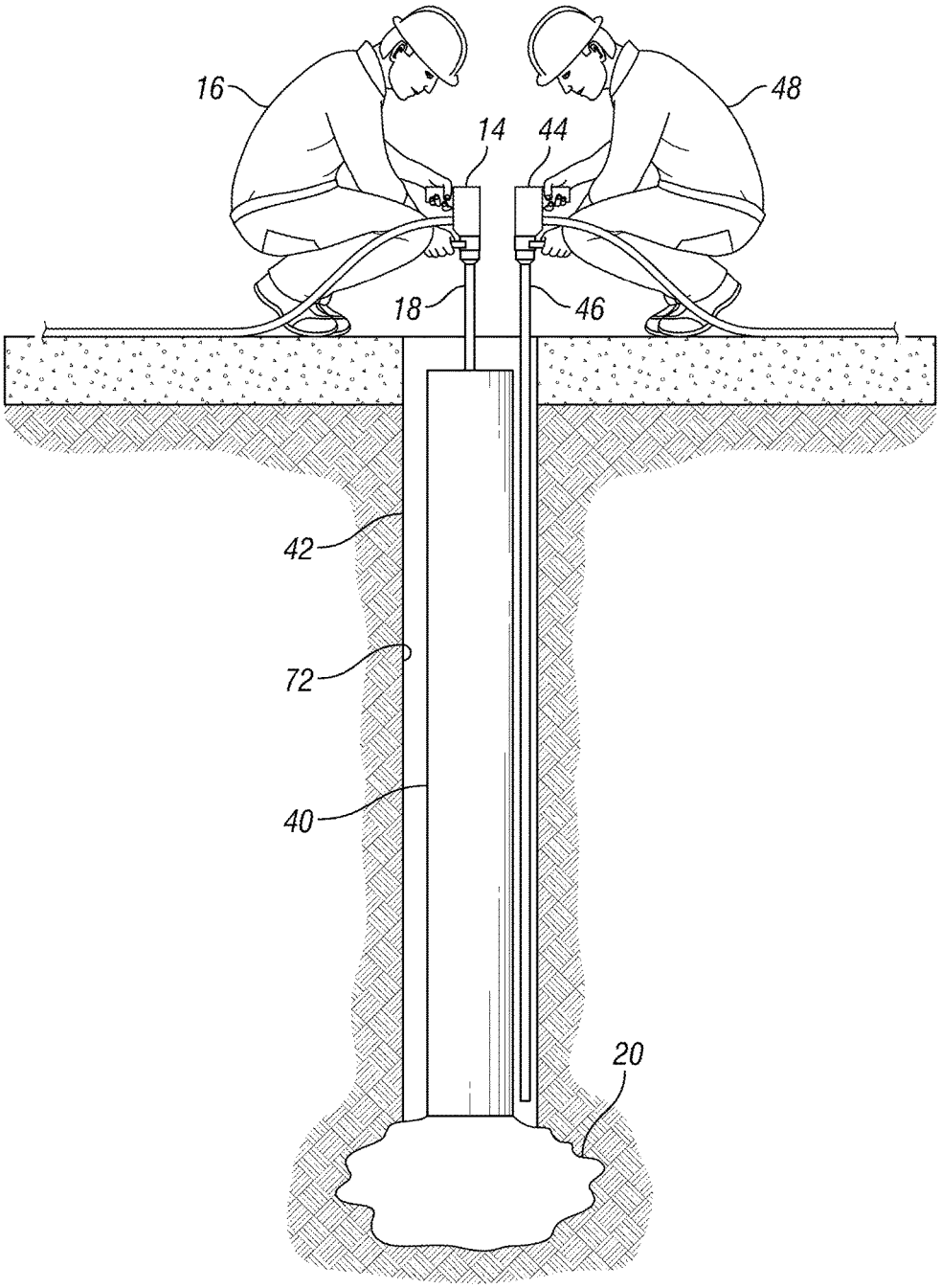
FIG. 8 represents one embodiment of a rapid pier using a casing having no perforations.

In the embodiment shown in FIG. 8, a casing 40 with no perforations is lowered into borehole 42. In this embodiment, operator 16 still injects a bell or base 20 at the bottom of non-perforated casing 40. The diameter of borehole 42 may be larger than the outer diameter of unperforated casing 40. To increase friction between unperforated casing 40 and the soil, operator 48 injects expandable material into the space between the exterior of unperforated casing 40 and the inner wall of borehole 42. FIG. 8 shows operator 48 directing exterior injection tube 46 down borehole 42, attached to exterior impingement gun 44. After unperforated casing 40 is injected with expansive material, operator 48 then injects expansive material 11 through exterior injection tube 46 into the space between casing 40 and borehole 42. The expansive material 11 used in the space between unperforated casing 40 and borehole 42 can be the same as used inside unperforated casing 40, or it can be tailored for use in improving friction. Likewise, the exterior surface of casing 40 can be scored to improve the bond between the casing surface and the expansive material 11. In the present embodiment, the injection into the space between the unperforated casing 40 and borehole 42 can be performed by operator 16 using impingement gun 14 after unperforated casing 40 is filled with expansive material. Although this embodiment describes injection in the annulus between the exterior surface of unperforated casing 40 and the interior surface of borehole 42, it is understood that the same method can be used with perforated casing as well. Likewise, the exterior injection can occur prior to the interior injection, or the two can occur at the same time. One of ordinary skill in the art would also recognize that different types of expansive material 11 can be utilized as between the interior of unperforated casing 40 and the annulus located between the exterior of unperforated casing 40 and the interior of borehole 42. Likewise, variations of expansive material 11 may be used within different regions of pipe 10 itself, depending on the nature of the soil at varying depths and other design parameters of the job.

Figure 10:
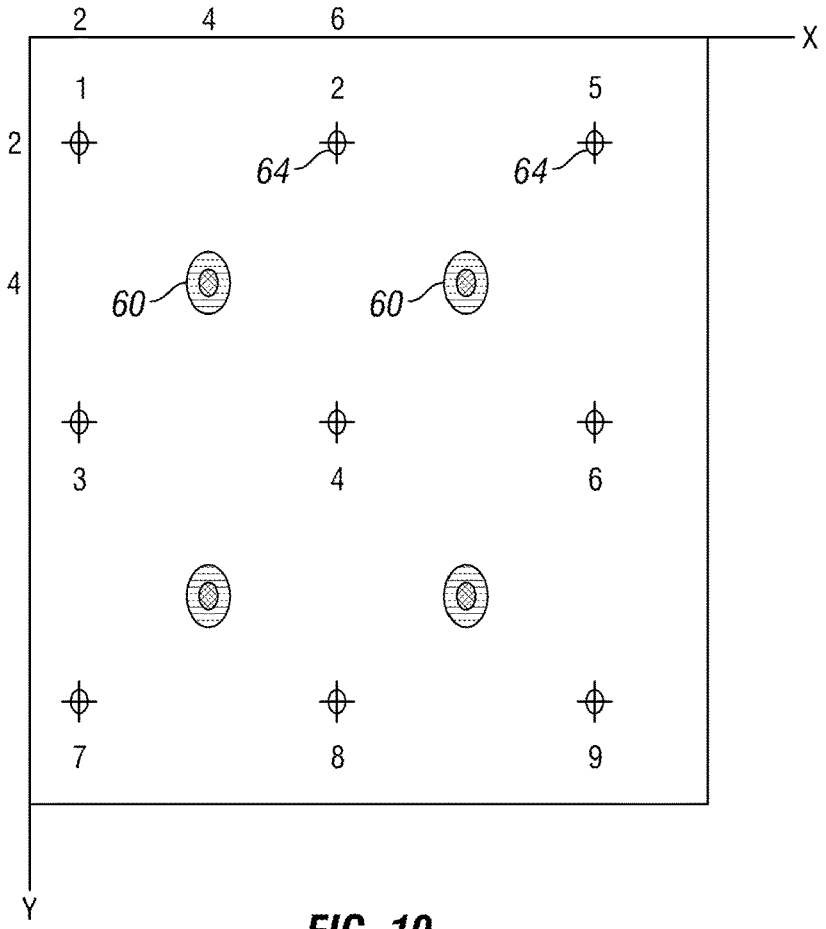
FIG. 10 shows a plan view of a rapid pier configuration with tie-in injections, according to one embodiment.

FIG. 10 shows an example of a slab plan view according to one embodiment of the present disclosure, where placed piers 60 are situated in a geometric configuration at a distance away from each other. A person of ordinary skill in the art would understand placement to be dependent on the engineering requirements of the load. Tie-in injections 64 may be used to provide additional support to the rapid pier configuration, with placement of tie-in injections 64 in between piers 60. Upon injecting expansive material 11, such as expanding polymer, in pipes 10 to create piers 60 having fingers 22, additional injections are made into the soil in between piers 60. These tie-in injections 64 link up with fingers or branches 22 of the piers 60 to provide a lattice of expanding polymer-reinforced soil. According to one embodiment, tie-injections are made at a depth of 3 feet from the surface. Other depths are possible, and can be selected based on the specifications of the foundation soil and the requirements of the job.

The rapid pier design is freely scalable to meet the geotechnical engineering needs of a foundation. For example, rapid piers can be sunk to many depths, such as 10 feet or 70 feet. Further depths are possible still. For unusually deep injections, the operator may elect a combination of top down and bottom up injections, drawing up tubes 18 as injections are made. The operator may elect to inject near the top to first create at stiff horizon. Tie-ins can be established at varying depths by injecting into the soil according to deep injection methods known in the art, for example, as disclosed in U.S. Pat. No. 6,634,831. Users of the rapid pier system may also employ aggregate filler within pipes 10. Aggregate takes up some of the interior volume of pipe 10, thereby reducing the required expansive material 11. It also provides tangible material for which expansive material to adhere to. According to one embodiment, aggregate is pumped into pipe 10 and vibrated to fill in any spaces.

Figure 11:
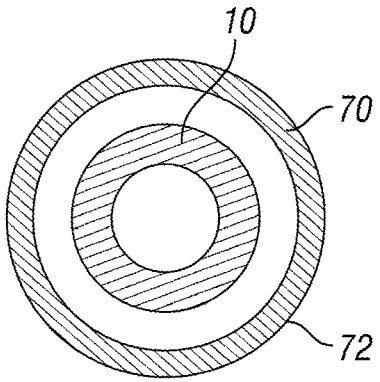
FIG. 11 shows a plan view of a rapid pier disposed in an external borehole casing, according to one embodiment of the disclosure.

Certain soils may present difficulties in setting pipe 10. As mentioned, pipe 10 may be sunk into the ground in situ. Or it may be placed into an open pre-drilled hole. Certain situations exist where loose soil becomes a concern, such as where the borehole 42 collapses prior to setting the pipe 10, or where soft soil falls into pipe 10 through perforations. In those cases, an operator may choose to first run an external borehole casing 70 into the hole. See FIG. 11. Pipe 10 is then sunk into the borehole casing 70 and the external borehole casing 70 is removed. This protects against soil entering pipe 10 prior to injecting the expanded material. This method can also create a void between the outer surface of pipe 10 and the inner surface 72 of the borehole 42, for use in further stabilization as disclosed in FIG. 8 and its accompanying text.

Figure 12:
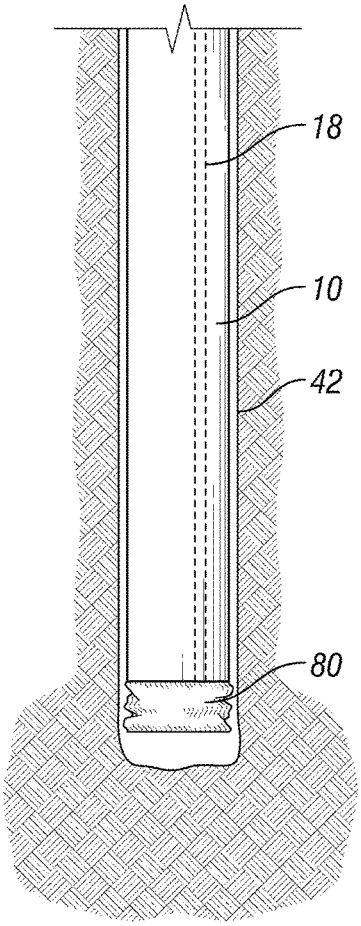
FIG. 12 represents an embodiment of the rapid pier having a compressed expandable container.
Figure 13:
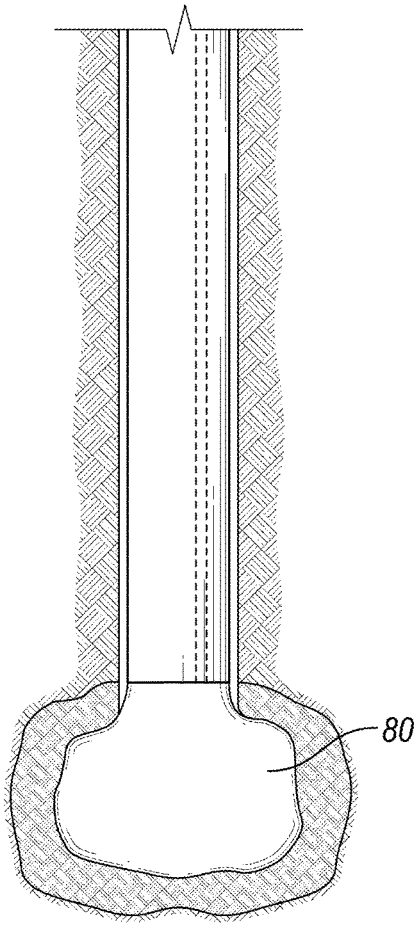
FIG. 13 demonstrates an embodiment of the rapid pier with an expanded expandable container.

In addition to fingers or branches 21 assisting in support of a vertical load, the rapid pier may also benefit from an expanded base or bell 20 at the bottom of pipe 10, as described in FIG. 1 and accompanying text. According to one embodiment, expansive material 11 is injected into the soil under pipe 10 and around its bottom portion, either from within the interior of pipe 10 or from outside, as shown in FIG. 8. FIG. 12 presents an alternative embodiment, having an expandable container 80 located below pipe 10. As expansive material is injected into expandable container 80, container 80 expands, whether by stretching or unfolding as described below, and densifies foundation soil in the immediate area, as seen in FIG. 13. Expandable container 80, in its expanded form, also provides a large base for improving the vertical load capability of the rapid pier.

Expandable container 80 may be made of container materials that readily accept and contain expansive material 11. These materials may be stretchable or elastic in nature, such as rubber, elastane, neoprene, spandex, or other stretchable fabrics known in the art. Expandable container 80, however, need not be fashioned from elastic material, but instead can employ folds. Exemplary materials for expandable container 80 include paper, mesh, fiberglass, polyester, textile, fabric, and other materials with similar characteristics. According to one embodiment, parachute fabric is used. As used herein, expandable container 80 need not stretch, but rather can employ folds so that container 80 is concertinaed or collapsed during placement under pipe 10. Upon receipt of expansive material 11, container 80 unfolds to densify the surrounding soil.

In one embodiment, expandable container 80 is placed elsewhere along pipe 10. For example, container 80 may be designed to exist midway between the vertical top and bottom of pipe 10, so that expansion forces portions of container 80 through perforations 12. Parts of container 80 designed to exit pipe 10 through perforations 12 can be specifically geometrically fashioned according to the load needs of the user.

Expandable container 80 may be connected to pipe 10 prior to pipe 10 being placed in borehole 42 or within external borehole casing 70 (if used). Or container 80 can be lowered into pipe 10, such as on the end of tube 18. In one embodiment, tube 18 also lowers a cap 21 above container 80 to reduce blowback of expansive material up pipe 10.

Figure 14:
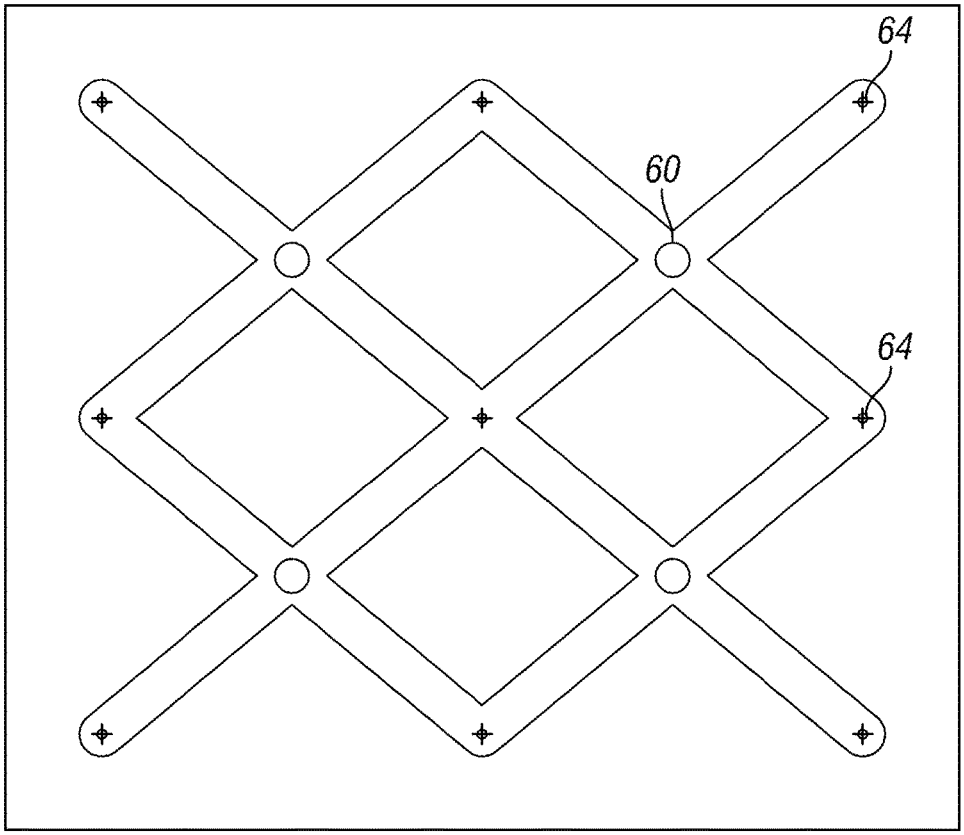
FIG. 14 shows a plan view of vertical shear walls of polyurethane-reinforced soil, according to one embodiment of the present disclosure.

Tests were performed using one embodiment of the present disclosure, sinking four polyvinyl chloride pipes 10 with perforations 12 in simulated foundation soil. Piers were situated four feet from each other and were sunk approximately nine feet. As represented in FIG. 10, nine tie-in injections 64 were made, interspersed between piers 60 approximately two feet from each other and 2.8 feet from piers 60. Tie-in injections were made approximately three feet below the surface. At the time of the test, it was thought excavation would reveal only fingers 21 extending from the rapid pier core into the surround soils. FIG. 14 is a simple representation of the results of the test from a top point of view, showing the unexpected formation of polyurethane-reinforced vertical shear walls emanating from the core of the rapid pier. These shear walls demonstrate the embodiment as creating a tied-together network of reinforced foundation soil, having the rapid piers at the core of the network.

Figure 15:
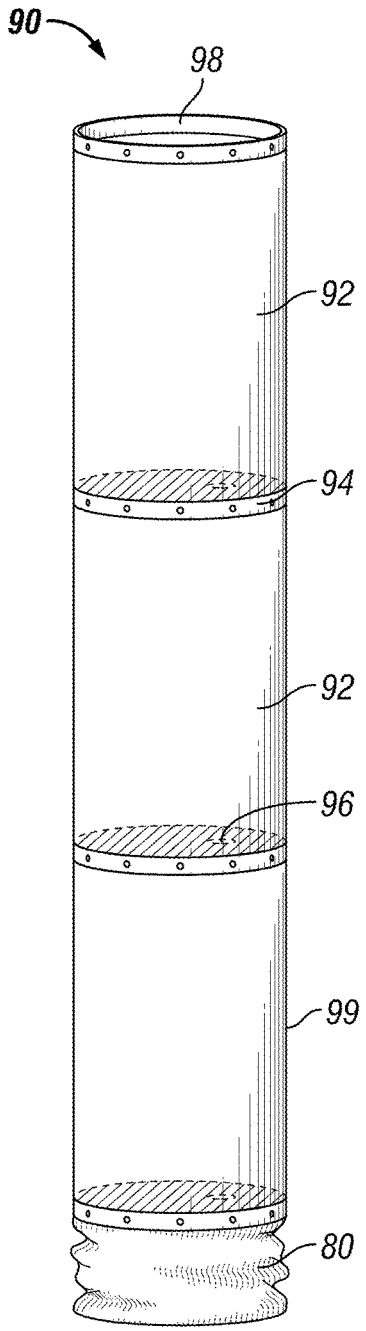
FIG. 15 represents a compartmentalized expansive material injection rack in a protracted configuration, according to one embodiment of the present disclosure.

FIG. 15 shows another embodiment according to the present disclosure. In this embodiment, pipe 10 is substituted with compartmentalized expansive material injection rack 90. One version of rack 90 is a self-contained pipe/casing unit having rigid, or semi-rigid wall 99, and compartments 92 for accepting expansive material 11. Compartments 92 are separated by compartment cap rings 94. Rings 94 remain in place while rack 90 is lowered into the hole, and also remain in place after the injection is complete. According to the embodiment shown in FIG. 15, rings 94 are solid enough to seal off the inner diameter of rack 90 from one compartment 92 to the next. In one embodiment, ring 94 comprises at least one injection tube hole 96 for allowing an injection tube 18 to pass from one compartment 92 to the next. Injection tube hole 96 preferably has a diameter slightly larger than the outer diameter of injection tube 18, though this need not be the case. In one embodiment, multiple injection tubes 18 can be threaded through a single larger injection tube hole 96. As one of ordinary skill in the art would understand, higher compartment cap rings 94 would require more (or larger) injection tube holes 96 in order to supply the lower compartments 92. FIG. 15 shows a compartment ring 98 having a hollow, or open, center region. Compartment ring 98, as one of ordinary skill in the art would understand, is interchangeable with compartment cap ring 94. When using compartment ring 98, an operator 16 injecting expansive material 11 would place a cap 21 on or over ring 98 to reduce the expansion of expansive material 11 from one compartment 92 to another.

Figure 16:
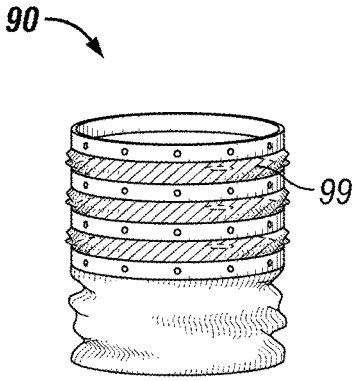
FIG. 16 depicts a compartmentalized expansive material injection rack in a collapsed configuration, according to one embodiment of the present disclosure.

FIG. 16 shows an alternative embodiment of compartmentalized expansive material injection rack 90. In this embodiment, rack 90 comprises flexible walls 99 (shown in FIG. 16 in a collapsed state). In the collapsed state, rack 90 takes up a fraction of the vertical space, which can allow for easier transportation to a jobsite. After a hole is drilled, collapsed compartmentalized expansive material injection rack 90 is lowered into the hole, unfurling as it drops to the bottom. With this design, operators can align injection tube holes 96 in cap rings 94 and thread injection tubes 18 prior to lowering injection rack 90. Flexible walls 99 can be fashioned from several types of material, including loose fitting mesh or burlap fabric. In one embodiment, flexible wall 99 fabric is permeable enough to allow some expansive material 11 to permeate into the surrounding foundation. In another embodiment, flexible wall 99 fabric is impermeable and instead contains perforations 12. In one embodiment, flexible wall 99 fabric is both permeable and contains perforations 12.

FIGS. 15 and 16 are shown having expandable container 80 connected to compartmentalized expansive material injection rack 90, though rack 90 need not include the expandable container 80 element. In an alternative embodiment, the lower most compartment 92 of rack 90 takes the place of expandable container 80. In this embodiment, sides 99 of the lower most compartment 92 comprise materials that readily accept and contain expansive material 11 and are stretchable or elastic in nature, such as rubber, elastane, neoprene, spandex, or other stretchable fabrics known in the art. Because the fabric of flexible wall 99 of the lower most compartment 92 is stretchable, injection of expansive material 11 stretches flexible wall 99 into the foundation to create a bell shape.

Although the present disclosure and its advantages have been described in detail, it should be understood that various changes, substitutions and alterations can be made herein without departing from the spirit and scope of the design as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. Moreover, the scope of the present application is not intended to be limited to the particular embodiments of the process, machine, manufacture, composition of matter, means, methods and steps described in the specification.

What is claimed is:

1. A method of constructing a support comprising:

placing into soil a plurality of casings, each casing having an inner diameter and an outer diameter and a plurality of perforations through the inner diameter and outer diameter;

placing an injection tube in the casings; and injecting through the injection tube expansive material into the casings and out of the casings through the perforations to form a plurality of piers, the piers having a plurality of fingers formed by the injection of material through the perforations; and injecting additional expansive material into the soil outside the casings between the piers such that the additional expansive material contacts at least some of the fingers of the plurality of piers.

2. The method claim 1, wherein the additional expansive material contacts at least some of the fingers of two adjacent piers.

3. The method of claim 1, further comprising placing a cap inside at least one of the plurality of piers to form a region for injection of expansive material within the pier casing, wherein the cap is configured to substantially seal a portion of the inner diameter of the pier casing above the cap from a portion of the inner diameter of the pier casing below the cap.

4. The method of claim 1, wherein the additional expansive material is injected into the soil at a depth of three feet from the surface of the soil.

5. A method for constructing a pier comprising:

forming in soil a borehole having an inner surface;

placing into the borehole a casing having an inner diameter and an outer diameter, wherein the difference between the outer diameter of the casing and the inner surface diameter of the borehole forms a space, and wherein the outer diameter of the casing is scored;

lowering an injection tube into the inner diameter of the casing;

lowering an injection tube into the space between the casing and the inner surface of the borehole;

injecting an expansive material into the casing; and injecting an expansive material into the space.

6. An apparatus comprising:

a plurality of piers in a geometric configuration at a distance away from each other, wherein the plurality of piers comprise:

a casing;

expansive material; and fingers extending outwardly from the casing through openings along the casing, the fingers comprising expansive material; and one or more tie-in injections between at least two of the plurality of piers, where the one or more tie-in injections comprise expansive material, the one or more tie-injections are configured to connect the fingers of at least two of the plurality of piers, and the one or more tie-in injections are not some of the plurality of piers.

* * * * *